United States Patent [19]

Belvederi et al.

[11] Patent Number: 5,022,415

[45] Date of Patent: Jun. 11, 1991

[54] MACHINE FOR SIMULTANEOUSLY MANUFACTURING TWO CONTINUOUS CIGARETTE RODS

[75] Inventors: Bruno Belvederi, S.Martino Di Monte S.Pietro; Franco Ghini; Davide Dall'Osso, both of Bologna, all of Italy

[73] Assignee: G.D. Societa per Azioni, Bologna, Italy

[21] Appl. No.: 446,976

[22] Filed: Dec. 6, 1989

[30] Foreign Application Priority Data

Dec. 6, 1988 [IT] Italy ..... 3693 A/88

[51] Int. Cl.[5] ..... A24C 5/18

[52] U.S. Cl. ..... 131/84.1; 131/108; 131/110; 131/904

[58] Field of Search ..... 131/84.1, 84.3, 108, 131/110, 904, 906

[56] References Cited

U.S. PATENT DOCUMENTS 4,372,326 2/1983 Seragnoli ..... 131/84.3

*Primary Examiner*—V. Millin

*Assistant Examiner*—Lynne A. Reichard

*Attorney, Agent, or Firm*—Marshall, O'Toole, Gerstein, Murray & Bicknell

[57] ABSTRACT

A machine for simultaneously manufacturing two continuous cigarette rods, whereby a continuous stream of shredded tobacco particles is fed to the bottom end of conveying means by which it is fed on to a pair of parallel suction conveyors traveling in a given direction, for forming on each conveyor a layer of tobacco of a given thickness; which conveying means comprise an upright defining internally a single upflow duct defined laterally by two walls extending in the traveling direction of the conveyors, and closed at the top by the two suction conveyors and by a separating member located between the same; provision also being made for pneumatic means for regulating the tobacco stream fed on to the conveyors.

8 Claims, 2 Drawing Sheets

MACHINE FOR SIMULTANEOUSLY MANUFACTURING TWO CONTINUOUS CIGARETTE RODS

BACKGROUND OF THE INVENTION

The present invention relates to a machine for simultaneously manufacturing two continuous cigarette rods.

Machines of the aforementioned type are known to feature a carding unit consisting of a number of carding rollers and designed to produce, at the output, a stream of tobacco particles substantially equal in width to the length of the carding rollers.

As described in U.S. Pat. No. 4,372,326 filed by the present Applicant, G.D. S.p.A., said stream of tobacco is divided equally into two parts by a dividing device, so as to form two streams of tobacco particles which are fed along respective upflow channels closed off at the top by respective suction conveyors.

Each suction conveyor collects the respective tobacco particles in known manner, and feeds them, in the form of a continuous stream, on to a paper strip.

To be more exact, the stream of tobacco from the carding unit comes out inside a duct located at the bottom of an upflow duct, which forks at the top end to form two side by side upflow channels arranged substantially in the form of a V and crosswise in relation to the traveling direction of the suction conveyors.

Said channels are separated by a dividing wall comprising a wedge-shaped bottom portion and arranged with its vertex facing the top end of the upflow duct.

Said wedge-shaped bottom portion usually presents mechanical or pneumatic dividing and regulating means for ensuring the tobacco stream is divided into two substantially equal parts.

A major drawback of the above dividing device is that it limits the output speed of the cigarette manufacturing machine, on account of the bottlenecks formed by the channel inlets, which clog easily if tobacco is fed too forcefully up the duct.

Another drawback of the above device is its complex design, by virtue of featuring said flow regulating means, which means comprise actuating means for adjusting the inclination of the wedge-shaped tip of the dividing wall, and so increasing one tobacco stream at the expense of the other.

Yet a further drawback of the above device is that the dividing wall limits access inside at least one of the two channels, thus making routine cleaning and maintenance of the channels extremely difficult.

SUMMARY OF THE INVENTION

The aim of the present invention is to provide a device for dividing a stream of tobacco, designed to overcome all the aforementioned drawbacks associated with known devices, and which is at once more economical and less complex in design.

With these aims in view, according to the present invention, there is provided a machine for simultaneously manufacturing two continuous cigarette rods, whereby a continuous stream of shredded tobacco particles is fed to the bottom end of conveying means by which said stream is fed on to a pair of parallel suction conveyors traveling in a given direction, for the formation on each said conveyor of a layer of tobacco of given thickness; characterised by the fact that said conveying means comprise an upright defining internally a single upflow channel defined laterally by two walls extending in the traveling direction of said conveyors, closed at the top by said two suction conveyors and by a separating member located between the same, and also comprising pneumatic means for regulating the tobacco stream fed on to said conveyors.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
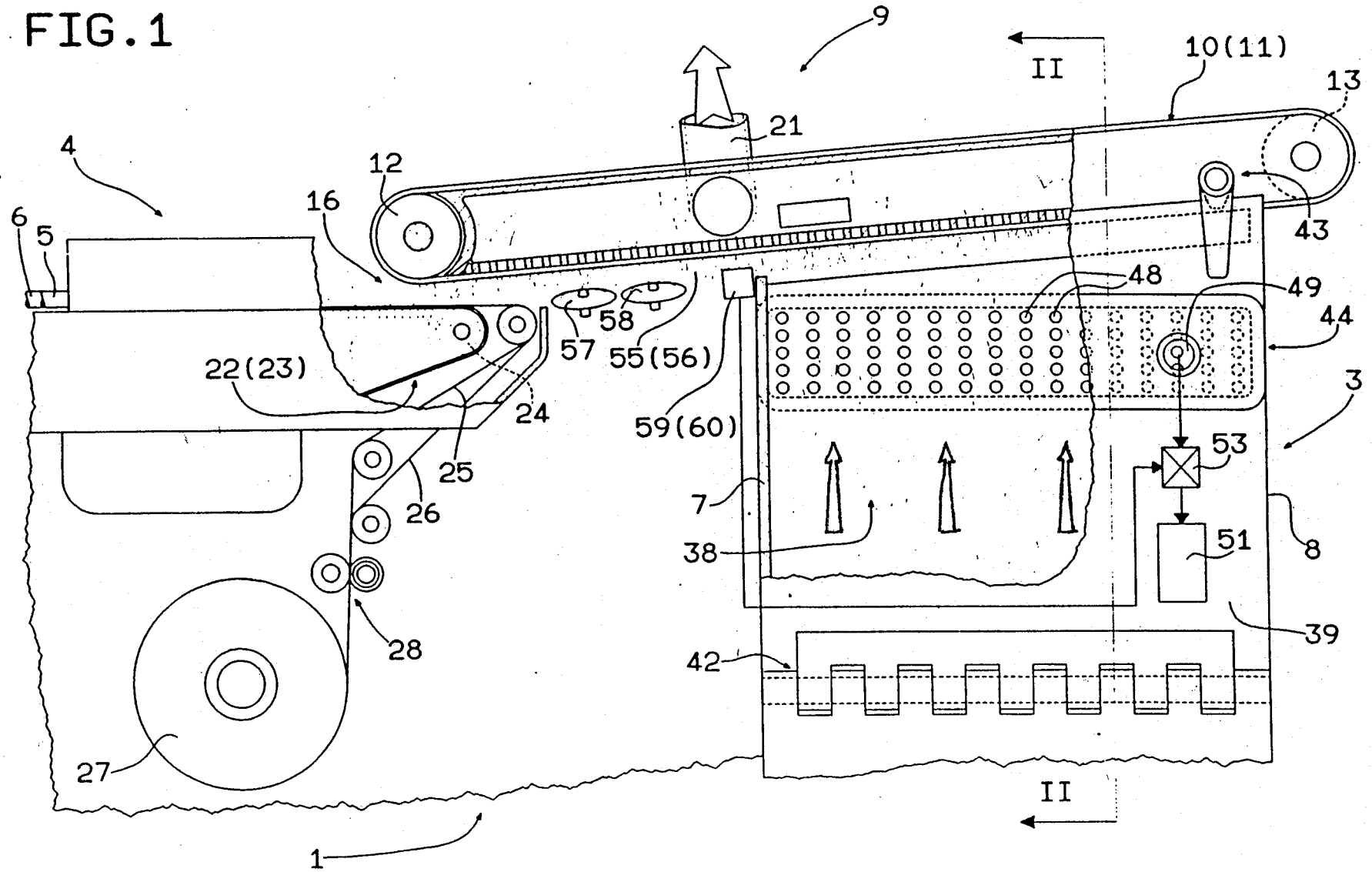
FIG. 1 shows a front view of the machine according to the present invention.
Figure 2:
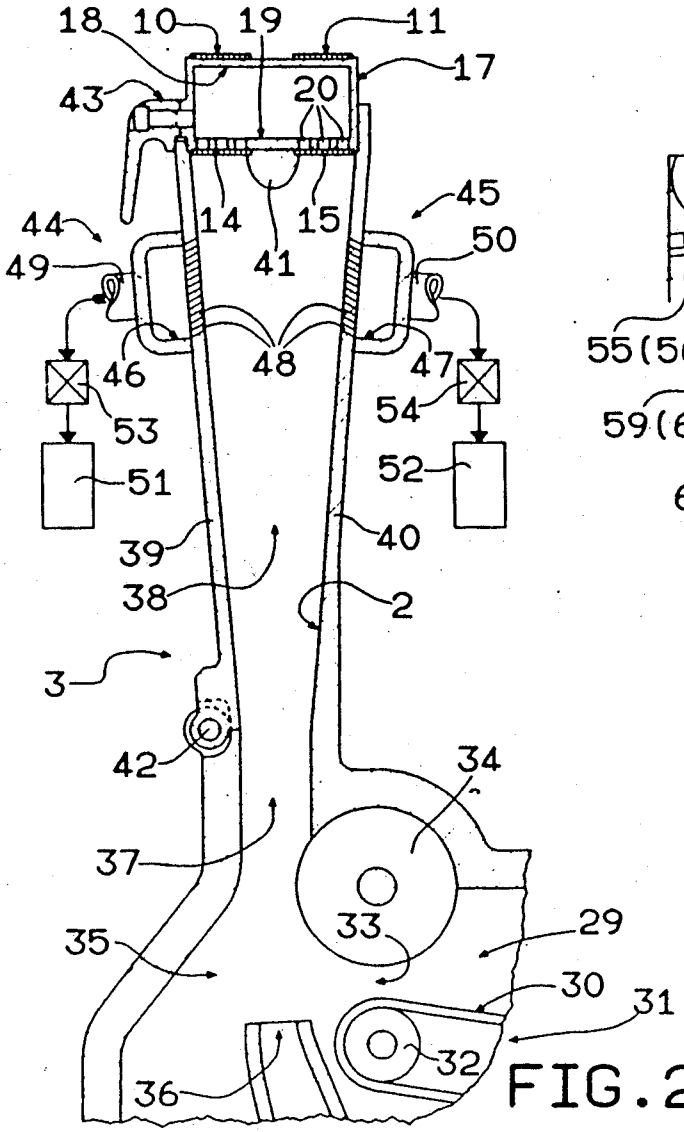
FIG. 2 shows a cross section of the machine according to the present invention.

Number 1 in FIGS. 1 and 2 indicates a machine for simultaneously manufacturing two continuous cigarette rods.

Said machine comprises a first section consisting of means for conveying a stream of tobacco and comprising an upflow duct 2 formed inside an upright 3; and a second section, indicated as a whole by 4, for forming two continuous cigarette rods 5 and 6 which are subsequently cut into single cigarettes (not shown).

Said duct 2, which is defined laterally by two vertical walls 7 and 8, and said section 4 are located below and connected by a conveyor system indicated as a whole by 9 and comprising two conveyor belts 10 and 11 arranged side by side and looped about two end rollers 12 and 13 turning clockwise (as shown in FIG. 1) about horizontal axes perpendicular to the FIG. 1 plane.

Roller 13 on the right is located higher than roller 12 on the left, so that the two bottom branches 14 and 15 of conveyors 10 and 11 slope upwards from left to right. The respective ends of branches 14 and 15 extend up to a so-called unloading station 16 at which the tobacco is fed on to section 4.

Bottom branches 14 and 15 and the respective top branches of conveyors 10 and 11 travel along the perimeter of a box-shaped body 17 defining an inner chamber 18.

Said chamber 18 is defined at the bottom by a wall 19 having through holes or slots 20 in the portion contacting branches 14 and 15, and communicates via a duct 21 with a suction source (not shown).

Said unloading station 16 is located at the confluence of said branches 14 and 15 and the top horizontal branches (only one of which is shown) of two conveyor belts 22 and 23 powered by an anticlockwise-rotating roller 24.

Numbers 25 and 26 indicate two strips of cigarette paper run in one piece off a common reel 27 and cut longitudinally by a rotary cutter 28.

The two strips 25 and 26 so formed are then fed respectively on to the top branches of conveyors 22 and 23 at said unloading station 16.

Number 29 in FIG. 2 indicates an inner chamber, the bottom of which is defined by the top branch 30 of a conveyor belt 31 looped about rollers 32 (only one of which is shown).

Branch 30 is designed to receive a stream of shredded tobacco from a known carding unit (not shown), and feed it into chamber 35 through a passage 33 defined between one of rollers 32 and a counter-rotating top roller 34. Said chamber 35 communicates at the bottom with a duct 36 connected to the outlet of a compressed air source (not shown) and, at the top, with said duct 2.

Duct 2 comprises a first substantially vertical portion or duct 37, the top end of which comes out inside a duct or channel 38 defined by two lateral walls 39 and 40 arranged substantially in the form of a V.

At the top end of upright 3, said duct or channel 38 is closed off by bottom branches 14 and 15 which are formed from material enabling the passage of air.

Integral with bottom wall 19 of box-shaped body 17, and located between and along the entire length of branches 14 and 15 inside duct 2, provision is made for a bar or strip 41 having a convex downward-facing cross section. The bottom end of front wall 39 (as viewed in FIG. 1) is connected to upright 3 of machine 1 by a hinge 42 having its axis perpendicular to walls 7 and 8.

Number 43 indicates locking means supported on box-shaped body 17 and designed to lock wall 39 in the closed position.

Walls 39 and 40 are provided with respective pneumatic means indicated as a whole by 44 and 45, for accelerating and regulating the stream of tobacco particles inside duct 2.

Said means 44 and 45, which are arranged symmetrically in relation to the center vertical plane of duct 2, comprise, outside respective walls 39 and 40, respective chambers 46 and 47 communicating via holes or openings 48 with duct or channel 38, and via respective ducts 49 and 50 with respective suction sources indicated schematically by blocks 51 and 52.

Provision is made along said ducts 49 and 50 for respective valve means 53 and 54 for regulating the suction force of said pneumatic means 44 and 45.

When machine 1 is operated, the stream of tobacco from the carding unit (not shown) is fed in the form of a continuous stream of tobacco particles to the bottom end of duct 2.

Assisted by the rising air current produced by duct 36 and accelerated by suction means 44 and 45, said stream of tobacco particles flows up vertical portion 37 and duct 38, wherein the slope of walls 39 and 40 provides for maintaining substantially uniform distribution over the entire width of duct or channel 38 as far as bottom branches 14 and 15.

As conveyor belts 10 and 11 travel through duct 2, and by virtue of the suction exerted by overhead body 17, respective layers of tobacco 55 and 56 (only one of which is shown in FIG. 1) are formed on branches 14 and 15.

Said layers 55 and 56 are formed from both the tobacco particles close to walls 39 and 40 of duct 2, which are fed directly on to branches 14 and 15, and by the particles in the center portion of duct 2, which are directed on to branches 14 and 15 by the convex surface of bar 41.

Outside duct 2 and upstream from unloading station 16, provision is made for two known shaving devices 57 and 58 for reducing and evening out the thickness of layers 55 and 56.

Under normal operating conditions, the same suction force is exerted by both pneumatic means 44 and 45. If, on the other hand, the amount of tobacco in either of layers 55 and 56 fails to conform with a given value, a respective known control device 59, 60, located between wall 7 and shaving devices 57 and 58, supplies a correction signal to valve means 53, 54 to which it is connected.

As a result of said signal, valve means 53 (54) is adjusted so as to regulate the suction force exerted by respective pneumatic means 44 (45) until said signal is cancelled.

Figure 3:
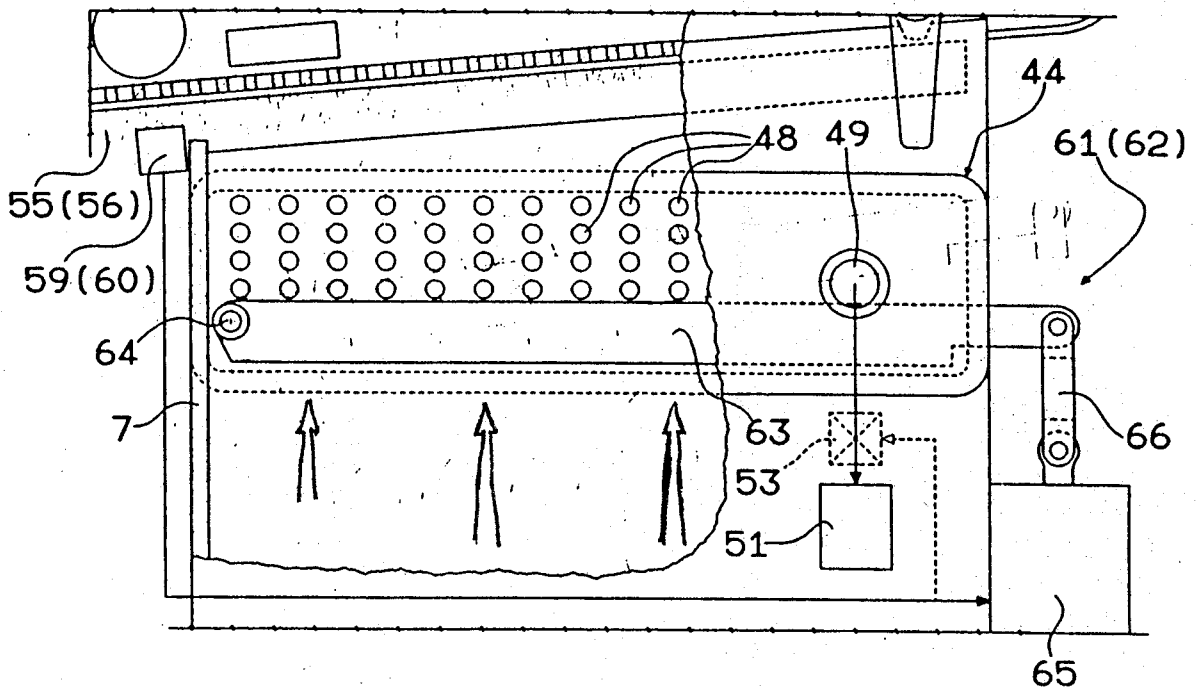
FIG. 3 shows a second embodiment of a detail in FIG. 1.

As shown in FIG. 3, the suction force exerted by pneumatic means 44 and 45 may be regulated via respective valve means 61 and 62.

As said valve means are identical, only those relative to pneumatic means 44 are shown in FIG. 3.

Said means consist of a blade 63 adhering to the outer face of wall 39 over the portion featuring holes 48, and pivoting on a pin 64 close to vertical wall 7.

An actuator 65, supported on wall 8 and connected by a connecting rod 66 to blade 63, provides for regulating the angle of blade 63 and consequently varying the number and/or position of holes 48 connected directly to suction source 51.

Valve means 61 and 62, which may also be operated in conjunction with said valve means 53 and 54, are also regulated by control means 55 and 56.

To those skilled in the art it will be clear that changes may be made to the machine as described and illustrated herein without, however, departing from the scope of the present invention.

For example, walls 39 and 40 may be substantially parallel.

The dividing device according to the present invention therefore provides for overcoming all the drawbacks typically associated with known devices.

An important point to note is that, on said device, the tobacco particles are fed on to conveyor belts 10 and 11 almost exclusively by means of an air current, with no assistance from the aforementioned mechanical means (dividing walls, the walls of the two ducts) by which the tobacco might be damaged.

We claim:

1. A machine (1) for simultaneously manufacturing two continuous cigarette rods (5,6), whereby a continuous stream of shredded tobacco particles is fed to the bottom end of conveying means by which said stream is fed onto a pair of parallel suction conveyors (10,11) traveling in a given direction, for the formation on each said conveyor of a layer of tobacco (55,56) of given thickness; characterized by the fact that said conveying means comprises an upright (3) defining internally a single upflow channel (38) extending through the entire cross section of said upright (3) for conveying a single stream of shredded tobacco defined laterally by two spaced apart walls (39,40) extending in the traveling direction of said conveyors (10,11), closed at the top by said two suction conveyors (10,11) and by a separating member (41) located between the same, and also comprising pneumatic means (44,45) for regulating the tobacco stream fed onto said conveyors (10,11).

2. A machine as claimed in claim 1, characterised by the fact that said two walls (39, 40) are arranged substantially in the form of a V with its vertex facing said bottom end.

3. A machine (1) for simultaneously manufacturing two continuous cigarette rods (5,6), whereby a continuous stream of shredded tobacco particles is fed to the bottom end of conveying means by which said stream is fed onto a pair of parallel suction conveyors (10,11) traveling in a given direction, for the formation on each said conveyor of a layer of tobacco (55,56) of given thickness; characterized by the fact that said conveying means comprise an upright (3) defining internally a single upflow channel (38) extending through the entire cross section of said upright (3) for conveying a single stream of shredded tobacco defined laterally by two spaced apart walls (39,40) extending in the traveling direction of said conveyors (10,11), closed at the top by said two suction conveyors (10,11) and by a separating member (41) located between the same, the channel being free, up to about its closed top, of any device which divides the channel into two vertical flow paths, and also comprising pneumatic means (44,45) on each of said two walls acting on said tobacco stream inside said duct (38) for regulating the tobacco stream fed on to said conveyors (10,11).

4. A machine as claimed in claim 3, characterised by the fact that said pneumatic means (44, 45) comprise valve means (53, 54; 61, 62) for regulating the division of said tobacco stream between said two suction conveyors (10, 11).

5. A machine as claimed in claim 4, characterised by the fact that said valve means are connected to devices (59, 60) for controlling the amount of tobacco in said layers (55, 56).

6. A machine as claimed in claim 3,
characterised by the fact that said separating member consists of a bar (41) having a convex downward-facing cross section.

7. A machine as claimed in claim 3,
characterised by the fact that at least one of said two walls (39, 40) is removable in relation to said upright (3) for enabling access inside said duct (38).

8. A machine as claimed in claim 7, characterised by the fact that said removable wall is connected to said upright (3) via hinge means (42); locking means (43) being provided for maintaining said wall in the closed position.

* * * * *